United States Patent [19]

Kelly

[11] 4,327,480

[45] May 4, 1982

[54] ELECTRICALLY CONDUCTIVE COMPOSITION, PROCESS FOR MAKING AN ARTICLE USING SAME

[75] Inventor: Cornelius J. N. Kelly, Simsbury, Conn.

[73] Assignee: Ensign-Bickford Industries, Inc., Simsbury, Conn.

[21] Appl. No.: 215,625

[22] Filed: Dec. 12, 1980

Related U.S. Application Data

[62] Division of Ser. No. 24,063, Mar. 26, 1979, Pat. No. 4,277,673.

[51] Int. Cl.[3] ..... H05B 3/00

[52] U.S. Cl. ..... 29/611; 219/528; 29/620

[58] Field of Search ..... 29/610 R, 611; 219/307, 219/504, 528, 535, 544, 548, 541, 549; 338/7, 20, 22 R, 212, 214; 174/110 PM, 126 R, 12 SC; 252/511; 264/104, 105, 234, 174; 428/235, 346, 214, 220

[56] References Cited

U.S. PATENT DOCUMENTS

| | | | |
|---|---|---|---|
| 3,412,358 | 11/1968 | Hummal et al. | 338/212 X |
| 3,435,401 | 3/1969 | Epstein | 338/214 |
| 3,793,716 | 2/1974 | Smith-Johannsen | 29/611 |
| 3,823,217 | 7/1974 | Kampe | 264/105 |
| 3,861,021 | 1/1975 | Smith-Johannsen | 29/611 |
| 3,900,654 | 8/1975 | Stinger | 338/225 X |
| 3,914,363 | 10/1975 | Bedard et al. | 264/105 |
| 4,169,816 | 10/1979 | Tsion | 252/511 |
| 4,177,446 | 12/1979 | Diaz | 338/212 |

*Primary Examiner*—Leon Gilden

*Attorney, Agent, or Firm*—Hayes & Reinsmith

[57] ABSTRACT

The method of manufacturing, composition and product described herein utilize highly electrically resistive carbon black alone or with low resistivity carbon black to form a self-limiting electrically resistive semi-conductor which presents a positive temperature co-efficient of resistance, the methods which are described providing significantly shortened anneal times, manufacturing ease and reliability.

4 Claims, 6 Drawing Figures

LOG OF RESISTANCE
7.00
6.00
5.00
4.00
3.00
2.00
1.00
0.00
0 1 2 3 4 5 6 7 8 9 10 11 12 13 14 15 16
ANNEALING TIME (HOURS)
KEY:
10% VULCAN XC 72
10% RAVEN 1255
10% HOGUL L

LOG OF RESISTANCE
7.00
6.00
5.00
4.00
3.00
2.00
1.00
0.00
0 1 2 3 4 5 6 7 8 9 10 11 12 13 14 15 16
ANNEALING TIME (HOURS)
KEY:
15% VULCAN XC 72
15% RAVEN 1255
15% HOGUL L

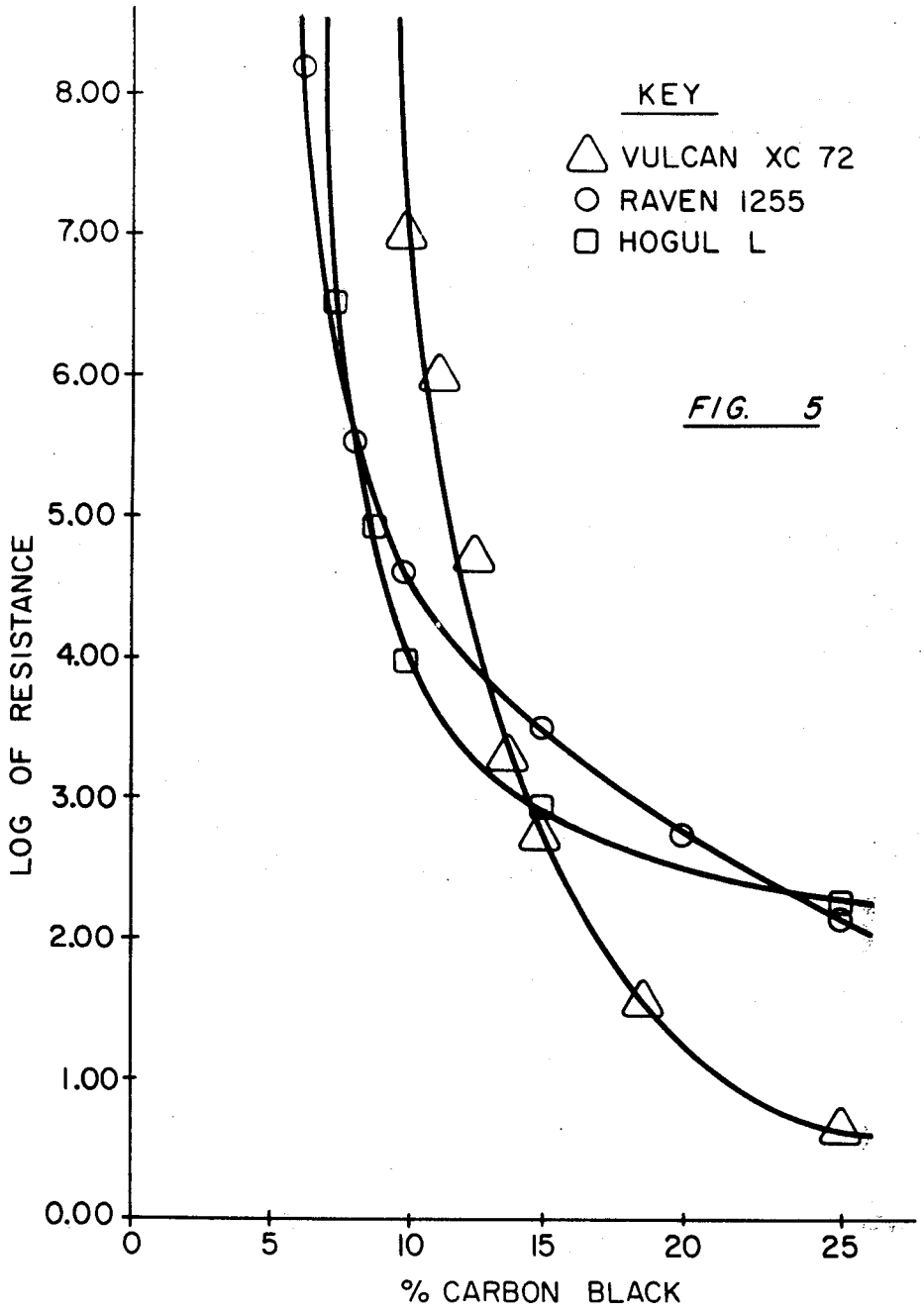
FIG. 5
FIG. 6
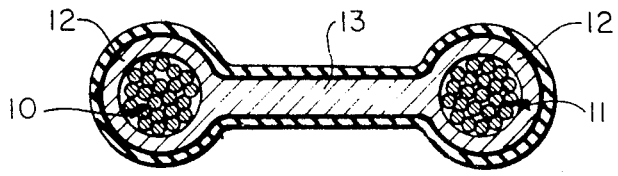

ELECTRICALLY CONDUCTIVE COMPOSITION, PROCESS FOR MAKING AN ARTICLE USING SAME

This is a division of application Ser. No. 24,063, filed Mar. 26, 1979, now U.S. Pat. No. 4,277,673.

BACKGROUND OF THE INVENTION

This invention relates to the composition of electrically semi-conductive devices having point-to-point electrical resistance that increases with increasing temperature as well as to a unique method for manufacturing such a semi-conductive composition as well as specific devices utilizing such a composition.

As pointed out in U.S. Pat. Nos. 3,435,401, 3,793,716, 3,823,217, 3,861,029, and 3,914,363, electrically conductive thermoplastic compositions have been prepared in the prior art by the addition of conductive carbon black to a polymeric base. The theory of operation of such compositions whereby such compositions provide a current limiting or positive temperature coefficient function has been thoroughly described. Moreover, the use of such self-regulating semi-conductive compositions and products using such compositions has been thoroughly described as having a large variety of uses ranging from electric heating to heat sensing and circuit breaker type applications. In each such use, however, it has been pointed out the disadvantage of the use of high carbon black loadings in connection with such products, such disadvantages including inferior elongation characteristics as well as inferior stress and crack resistance. While it is well known that semi-conductive thermoplastic compositions will show a resistivity rising with temperature, such compositions have also shown negative temperature co-efficients which accompany use of semi-conductive composition above that temperature at which the polymer will melt.

It is clear, however, that all of the prior art teachings known to applicant have dealt specifically with the utilization of what is referred to as low volume resistivity carbon blacks such as are described in the Cabot Corporation's Pigment Black Technical Report S-8 entitled "Carbon Blacks For Conductive Plastics". A typical conductive carbon black in extensive use is Cabot Vulcan XC72, an oil furnace black having a critical volume resistivity occurring at or about 15% by weight of the carbon black in the basic matrix. Moreover, the prior art assumes that electrically conductive thermoplastic compositions shall use such highly conductive carbon blacks and therefore much effort has been addressed to related issues of physical properties resulting from use of such carbon blacks in varying densities.

OBJECTS OF THE INVENTION

It is a primary object of this invention to provide an improved polymeric semi-conductive composition exhibiting useful low electrical resistance by blending high electrical resistivity carbon black with a crystalline polymer to provide a composition having a positive temperature co-efficient of resistance.

It is also a primary object of this invention to utilize a blend of highly conductive and highly resistive carbon blacks to prepare a product having a positive temperature co-efficient of electrical resistivity while being easily manufactured with a high degree of reliability and, at the same time, avoiding highly complicated and lengthy thermal structuring operations.

It is a further object of this invention to provide an improved product which is easily extruded or otherwise formed to present a semi-conductive self-limiting positive temperature co-efficient of resistance element susceptible of a wide variety of uses.

It is an additional object of this invention to provide for the economical formation of self-limiting conductive articles which are characterized by a blend of both low and high conductive carbon disposed in a polymeric matrix whose stabiity and predictability of resistance is easily obtained with very short time period thermal structuring.

Other objects will be in part obvious and in part pointed out in more detail hereinafter.

A better understanding of the objects, advantages, features, properties and relations of the invention will be obtained from the following detailed description and accompanying drawings which set forth certain illustrative embodiments and are indicative of the various ways in which the principles of the invention are employed.

SUMMARY OF THE INVENTION

In accordance with the present invention, it has been determined that utilization of carbon blacks having high dry volume resistivities in a variety of concentrations both alone or with carbon blacks having a low dry volume resistivity will produce conductive polymers which require much shorter anneal times than heretofore obtained with a higher degree of reliability and a lower degree of manufacturing waste.

BRIEF DESCRIPTION OF THE DRAWINGS

In the Drawings:

FIG. 5 is a graph of % carbon black by weight in a test plaque versus the log of the plaque resistance; and FIG. 6 is a cross-section view of a typical heating cable of this invention.

DETAILED DESCRIPTION OF THE INVENTION

Figure 1:
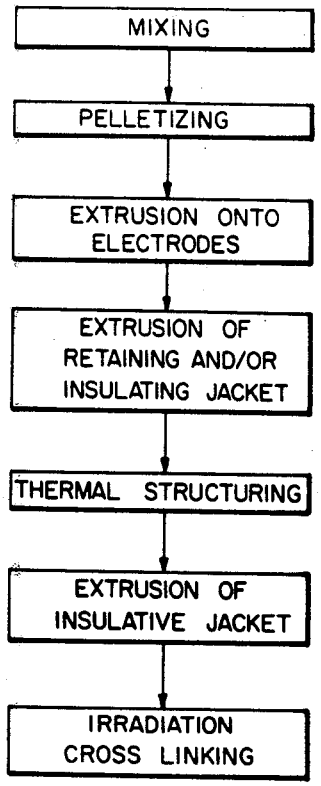
FIG. 1 is a chart showing typical manufacturing steps usable in the invention.

In order to best understand the background and scope of the present invention, attention is directed to FIG. 1 which shows typical steps in the formulation of a semi-conductive mix to form such devices as self-regulating heating cables.

In the mixing step, the carbon black (low dry volume resistivity carbon black in the prior art) is incorporated into thermoplastic materials such as polyolefins, etc. through utilization of a high-sheer intensive mixer such as a Banbury Mixer. The material from the Banbury Mixer can be pelletized by feeding it into a chopper and collecting the chopped material and feeding it to a pelletizing extruder.

The pelletized mix can be used for subsequent casting of the mix or for extrusion onto appropriate electrodes to produce heating wire, sensing devices, etc. and thereafter the product is provided, if desired, with the extrusion of a suitable shape retaining and/or insulating jacket followed by thermal structuring which is hereinafter described as involving annealing. If desired, a further insulating jacket may be extruded or otherwise provided and, also if desired, radiation cross-linking can be used to provide certain functional characteristics in the product, all of such steps being well known in the prior art.

The concentration of carbon black in self-regulating cables has not to this time been high enough to produce a composition or product which is electrically conductive when first extruded because of undesirable physical characteristics. U.S. Pat. No. 3,861,029 points out that articles with high carbon black loadings (so as to produce desired conductivity when first prepared) exhibit inferior characteristics as to flexibiliy, elongation and crack resistance; they also exhibit undesirably low resistivity when brought to peak temperatures. In such instances, the poor heat transfer characteristics generally produce what is known as cable burn-out which burn-out is best described as the condition which exists when the polymeric composition reaches a temperature above its crystalline melting point and then takes on the characteristics of a negative temperature co-efficient resistor which is self-destructive.

In accordance with the prior art, the desired conductivity is obtained by subjecting the initially non-conducting extrudate or the composition containing the mixture to a thermal structuring process (annealing) consisting of keeping the mixture at a temperature above the crystalline melting point of the polymeric material for varying time periods but generally thought to be more than 15 hours. Under such conditions, it has been necessary to maintain the integrity of the semi-conductive composition with an appropriate confining jacket which has a melting point which is higher than that of the annealing temperature and the prior art shows such structural retaining jackets to be typically polyurethane, polyvinylidene fluoride elastomers, silicone rubbers or the like. Certain prior art teachings postulate a far more severe temperature time relationship than what is normally employed for mere strain relief or improved conductor electrode wetability, i.e., exposure to 300° F. for periods in the order of 24 hours.

Again referring to FIG. 1, a further jacket can be provided as by extrusion upon the product so as to protect the product and/or the user, such a jacket being thermoplastic rubbers, PVC fluoropolymers such as Teflon FEP or TEFZE L (products of E. I. duPont de Nemours) or the like. Finally, to improve the mechanical properties, such as toughness, flexibility, heat resistance and the like, the basic product thereby produced can be cross-linked preferably by radiation cross-linking during which the radiation dosage is established so as to avoid diminution of the crystallinity of the core material to less than approximately 20%.

Prior art techniques have utilized carbon blacks having a low dry volume resistivity in concentrations up to about 15% by weight and require rigorous annealing and often produce compositions which have resistances which are too high to be of practical use. The aforementioned Cabot Corporation Pigment Black Technical Report establishes that the expected and traditional carbon black to be utilized is the so-called low dry volume resitivity black with concentrations of about 15% or greater of such carbon black.

Contrary to the teachings of the prior art, utilization of carbon blacks having high dry volume resistivities can produce significant and unexpected advantages. The dry volume resistivity characteristic of carbon blacks can be defined as the ratio of the potential gradient parallel to the current in the material to the current density and is generally measured in ohms per centimeter. Carbon blacks having high dry volume resistivities are considered to be poor electrical conductors while the converse is true with regard to those carbon blacks having low dry volume resistivities. Typical dry volume resistivities for various commercially obtainable carbon blacks are shown in the following TABLE I:

TABLE I

| Carbon Black | Supplier | Dry Volume Resistivity 0.54 grms/cc |
|---|---|---|
| Vulcan XC72 | Cabot Corporation | 0.37 ohm cm |
| Mogul L | Cabot Corporation | 3.17 ohm cm |
| Raven 1255 | Cities Service Co. | 4.64 ohm cm |

By definition, a highly conductive carbon black such as Vulcan XC72 would appear to be the most useful carbon black when incorporated in a plastic such as polyethylene and it should be expected to produce a highly electrically conductive composition. Such an expected result is true for compositions having carbon black loadings greater than 15% and pointed out by the prior art. Moreover, the prior art has directed its attention to the utilization of carbon black loadings at 15% or lower followed by rigorous thermal structuring or annealing in order to produce a product having a useful resistance level as well as a stable resistance.

Figure 2:
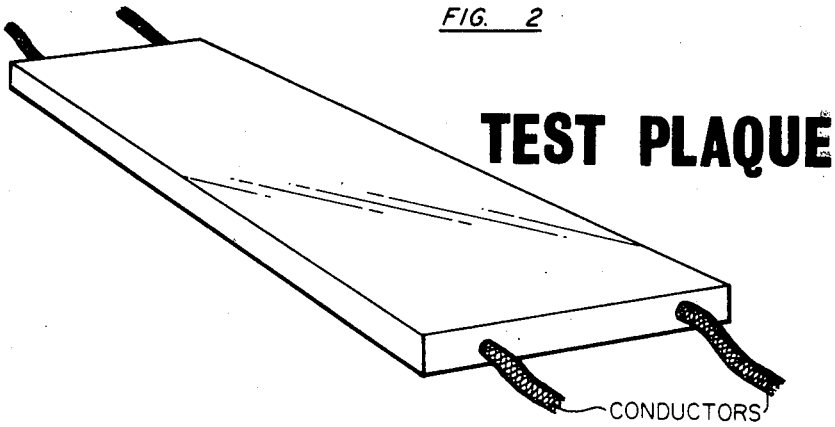
FIG. 2 is an isometric view of a test plaque.

Before proceeding with the details of certain test results, reference to FIG. 2 shows a typical test plaque which has been used in determining much of the experimental data set forth in the tables and graphs. Such a plaque results from taking the materials which have been prepared in the Banbury Mixer at 275° F. for approximately 5 minutes and placing the mix in a Carver press to provide a compression-molded plaque having the approximate dimensions of $5\frac{1}{2}'' \times 2'' \times \frac{1}{4}''$ containing two parallel 14 gauge tin plated wires separated by approximately one inch. By connecting an appropriate resistance measuring device such as a Wheatstone Bridge, ohm meter or the like to the wire terminals of the test plaque, resistance across the two wire conductors before and after annealing can be determined.

Using the foregoing plaque technique, it was determined that the conductivity of a plaque having 20% Vulcan XC72 (low resistivity) carbon black had a room temperature resistance of 15.9 ohms while one containing 20% Mogul L (high resitivity) carbon black had a resistance of 316 ohms, both plaques using the same polymeric material. Moreover, the Mogul L plaque required a significantly shorter anneal time to reach a stable and constant room temperature resistance. This same characteristic of shorter anneal times was found to be true for blends of the high resistivity carbon blacks with the low resistivity carbon blacks as shown in the following TABLE II:

TABLE II

| | EXAMPLES ILLUSTRATING INVENTION | | | | | | | |
|---|---|---|---|---|---|---|---|---|
| | (1) | (2) | (3) | (4) | (5) | (6) | (7) | (8) |
| Polyethylene (1) | 74 | 74 | 74 | 69 | 69 | 69 | 69 | 69 |

TABLE II-continued

| EXAMPLES ILLUSTRATING INVENTION | (1) | (2) | (3) | (4) | (5) | (6) | (7) | (8) |
|---|---|---|---|---|---|---|---|---|
| Ethylene-Ethylacrylate (2) | 16 | 16 | 16 | 16 | 16 | 16 | 16 | 16 |
| Carbon Black, Vulcan XC72 (3) | 10 | — | — | 15 | — | — | 5 | 5 |
| Carbon Black, Mogul L (4) | — | 10 | — | — | 15 | — | 10 | — |
| Carbon Black, Raven 1255 (5) | — | — | 10 | — | — | 15 | — | 10 |
| | 100 | 100 | 100 | 100 | 100 | 100 | 100 | 100 |
| Annealing Time (hrs) (6) | 64 | 3½ | 5 | 8 | 2½ | 3 | 4 | 5 |
| Resistance (ohms × $10^3$) (7) | 100 | 8 | 44 | 1.3 | 1.1 | 3.8 | 1.4 | 2.8 |

Notes:
(1) Union Carbide Corporation's DFD6005 having a density of 0.92 g/cc.
(2) Union Carbide Corporation's DPDA9169 having a density of 0.931 and ethylacrylate content of 18%.
(3) Cabot Corporation's most conductive grade of carbon black.
(4) Cabot Corporation's least conductive grade of carbon black.
(5) Cities Service Co.'s least conductive grade of carbon black.
(6) Annealing is defined as the time required to bring from a resistance of about $10^8$ ohms to about $10^3$ ohms.
(7) The resistance of the test plaque is then measured by measuring the resistance across the two wire conductors after annealing the plaque to a constant resistance value.

This apparently anomalous behavior would appear to be explained by the data shown in the following Table III which data shows that carbon blacks of apparently low conductivities as measured by their dry volume resistivities are in fact significantly more conductive when used in the range of approximately 5 to 15% than the commonly used high conductivity carbon black which has a low dry volume resistivity which is approximately 10 orders of magnitude less. The phenomenon allows use of lower amounts of a low conductive carbon black to obtain higher conductivities with attendant shorter annealing times.

TABLE III

| Carbon Black | Anneal Time To Reach A Constant Resistance | Resistance Of Plaque at 70° F. |
|---|---|---|
| 10% Vulcan XC72 | 64 hours | 100 × $10^3$ ohms |
| 10% Mogul L | 3½ hours | 8 × $10^3$ ohms |
| 10% Raven 1255 | 5 hours | 44 × $10^3$ ohms |

Generally, in order to obtain a polymeric composition exhibiting a positive temperature co-efficient of resistance, the polymeric matrix in which the carbon black is dispersed must exhibit a nonlinear co-efficient of thermal expansion for which reason a degree of crystallinity is deemed essential. Polymers having at least 20% crystallinity as determined by X-ray diffraction are suited to the practice of this invention. Examples of such polymers are polyolefins such as low, medium, and high density polyethylenes, polypropylene, polybutene-1, poly (dodecamethylene pyromellitimide), ethylene-propylene copolymers, and terpolymers with non-conjugated dienes, fluoropolymers such as the homopolymers of chlorotrifluoroethylene, vinyl fluoride and vinylidene fluoride and the copolymers of vinylidene fluoride-chlorotrifluoroethylene, vinylidene fluoride-hexafluoropropylene, and tetrafluoroethylene-hexafluoropropylene. While the examples listed so far are thermoplastic materials, non-melt-flowable materials such as ultrahigh molecular weight polyethylene, polytetrafluoroethylene, etc., can also be used. As will be recognized by those skilled in the art, the selection of the polymeric matrix wil be determined by the intended application. The following examples illustrate applicant's invention as applied to the manufacture of a typical heating cable element.

EXAMPLE 1

1.81 lbs. of polyethylene (density 0.920 g/cc), 0.39 lbs. of ethylene ethylacrylate copolymer (density 0.931 g/cc and ethylacrylate content of 18%), 0.24 lbs. of Mogul L carbon black, were loaded into a Banbury mixer preheated to 210° F. The ram was closed and mixing commenced. Mixing was continued for about 3 minutes after a temperature of 270° F. was attained. The batch was dumped, chopped, and pelletized. The carbon black content by weight of composition was 10%. The pelletized compound was next extruded onto two tinned copper electrodes (18 AWG 19/30) to form an extrudate having dumbbell-shaped cross section. The electrodes were 0.266 inches apart and the interconnecting web about 0.022 inches thick. Onto this carbon black filled core was next extruded a 49 mil. thick insulation jacket of a thermoplastic rubber (TPR-0932 available from the Uniroyal Chemical Co.). After jacketing, the heating cable had a flat configuration. The jacketed product was next spooled onto a 36" diameter metal drum and exposed to 300° F. in an air circulating oven until the room temperature resistance per foot had reached a constant value. In this case the constant room temperature resistance per foot of cable achieved was 400×$10^3$ ohms and the time to achieve it was 7½ hours.

EXAMPLE 2

Similar as in Example 1 except that the content of carbon black by weight of composition was 15% Mogul L. In this case the constant room temperature resistance per foot of cable achieved was 4×$10^3$ ohms and the time to achieve it was 6½ hours.

EXAMPLE 3

Similar as in Example 1 except that the content of carbon black by weight of composition was 20% Mogul L. In this case the constant room temperature resistance per foot of cable achieved was 0.6×$10^3$ ohms and the time to achieve it was 3 hours.

EXAMPLE 4

Similar as in Example 1 except that the content of carbon black by weight of composition was 25% Mogul L. In this case the constant room temperature resistance per foot of cable achieved was 0.2×$10^3$ ohms and the time to achieve it was 2 hours.

In contrast, when Cabot Corporation's Vulcan XC72 carbon black, which is regarded as being one of the most conductive carbon blacks available, was used instead of Mogul L, the following results were obtained:

EXAMPLE 5

Similar as in Example 1 except that the content of carbon black by weight of composition was 10% Vulcan XC72. In this case a constant room temperature resistance per foot of cable was not achieved within 24 hours. The resistance at 24 hours was found to be greater than $4\times10^7$ ohms per foot.

EXAMPLE 6

Similar as in Example 1 except that the content of carbon black by weight of composition was 15% Vulcan XC72. In this case a constant room temperature resistant per foot of cable achieved was $40\times10^3$ ohms and the time to achieve it 13 hours.

EXAMPLE 7

Similar as in Example 1 except that the content of carbon black by weight of composition was 20% Vulcan XC72. In this case a constant room temperature resistance per foot of cable achieved was $0.06\times10^3$ ohms and the time to achieve it was 8 hours.

EXAMPLE 8

Similar as in Example 1 except that the content of carbon black by weight of composition was 25% Vulcan XC72. In this case a constant room temperature resistance per foot of cable achieved was $0.01\times10^3$ ohms and the time to achieve it was 2½ hours. Table IV summarizes the above results:

TABLE IV

| CARBON BLACK | ANNEAL TIME TO REACH A CONSTANT RESISTANCE | HEATING CABLE RESISTANCE AT 70° F. |
|---|---|---|
| 10% Mogul L | 7½ hours | $400\times10^3$ ohms/ft |
| 15% Mogul L | 6½ hours | $4\times10^3$ ohms/ft |
| 20% Mogul L | 3 hours | $0.6\times10^3$ ohms/ft |
| 25% Mogul L | 2 hours | $0.2\times10^3$ ohms/ft |
| 10% Vulcan XC72 | > 24 hours | $>4\times10^7$ ohms/ft |
| 15% Vulcan XC72 | 13 hours | $40\times10^3$ ohms/ft |
| 20% Vulcan XC72 | 8 hours | $0.06\times10^3$ohms/ft |
| 25% Vulcan XC72 | 2½ hours | $0.01\times10^3$ ohms/ft |

EXAMPLES 9–12

Additional extrudates were prepared with a constant carbon black loading but with various ratios of Mogul L carbon black to Vulcan XC72 carbon black following the procedure of Example 1. The data obtained using these extrudates is shown in the following Table V and shows that the higher the Mogul L carbon black content, the shorter the annealing time to constant resistance.

TABLE V

| CARBON BLACK BLEND | TIME TO REACH A CONSTANT RESISTANCE | RESISTANCE AT 70° F. |
|---|---|---|
| 0% ML/20% XC72 | 8 hours | $0.06\times10^3$ ohms/ft |
| 5% ML/15% XC72 | 6 hours | $0.3\times10^3$ ohms/ft |
| 10% ML/10% XC72 | 5 hours | $0.5\times10^3$ ohms/ft |
| 15% ML/5% XC72 | 4 hours | $0.9\times10^3$ ohms/ft |

ML = Mogul L carbon black
XC72 = Vulcan XC72 carbon black

Figure 3:
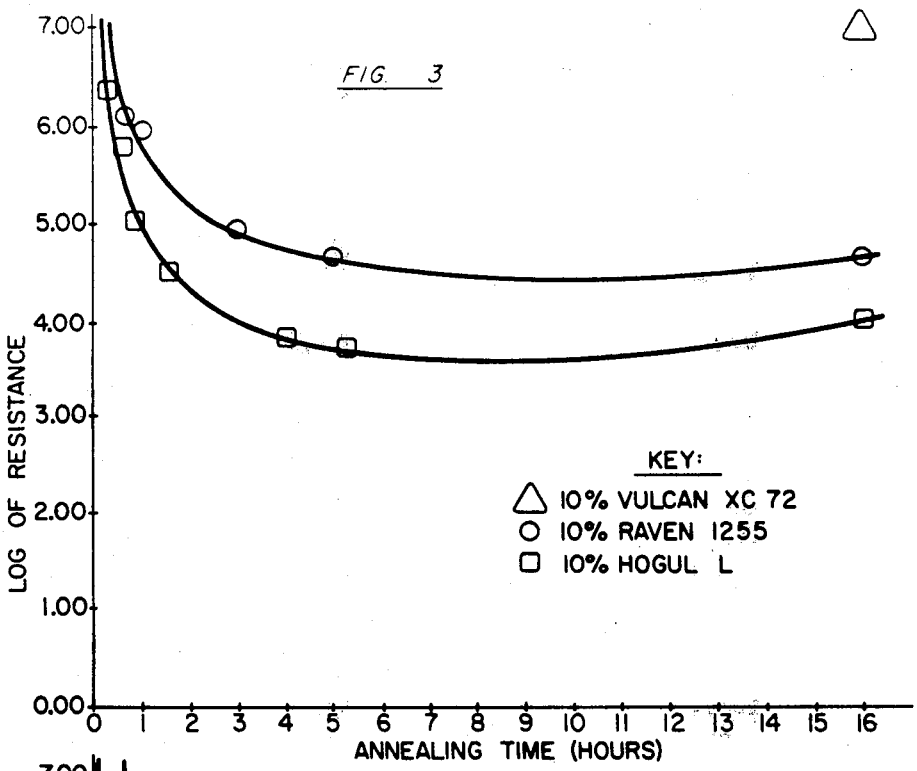
FIG. 3 and FIG. 4 are graphs of anneal time versus the log of the resistivity of a test plaque.

Turning next to the FIG. 3 drawing, the graph of the log of resistance versus the anneal time in hours for 3 compositions utilizing 10% concentrations of carbon black ranging from highly conductive (Vulcan XC72) to highly resistive (Mogul L and Raven 1255) it is seen that utilization of the 10% highly resistive conductive blacks produce a useful and predictable substantially constant resistance after about approximately 5 hours of anneal time whereas the 10% mix of the highly conductive (Vulcan XC72) mix is just barely on the face of the graph after 16 hours of anneal time.

Figure 4:
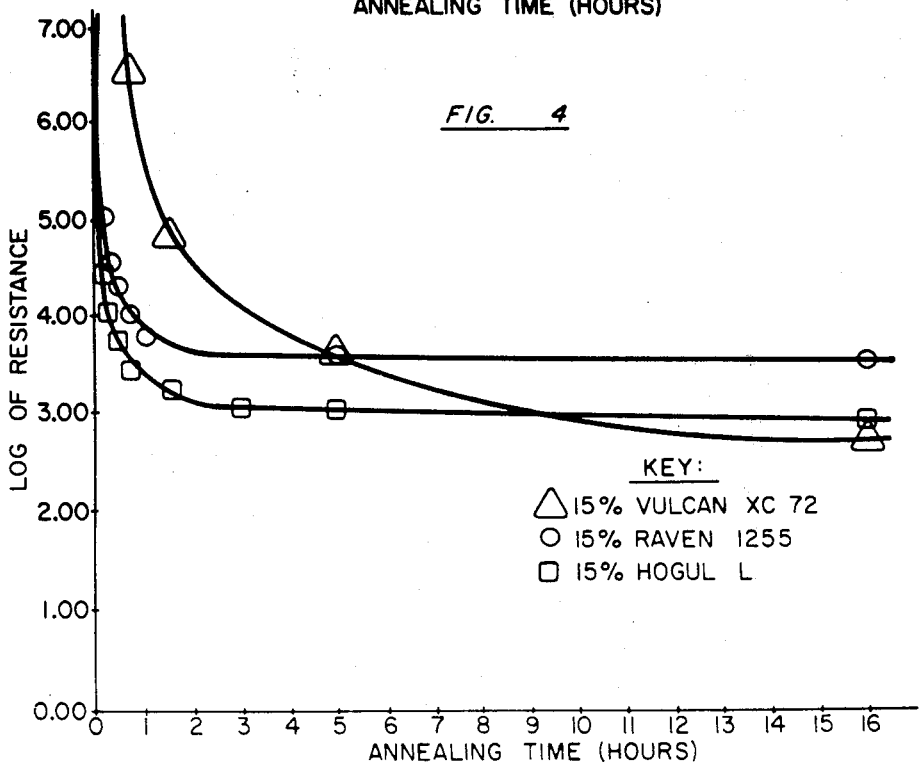

Turning next to the graph of FIG. 4, showing 15% carbon black mixture, it is seen that stability is obtained with both the 15% Raven 1255 and 15% Mogul L after approximately 4 hours of anneal time whereas the 15% Vulcan XC72 (the highly conductive carbon black) is still seeking its constant resistance stability at nearly 16 hours of anneal time. The anomaly of shortened anneal time with useful stable resistances achieved through utilization of highly resistive carbon blacks is thus shown by such curves.

In FIG. 5, showing a graph of the log of the resistance versus the percent carbon black, it is seen that a certain criticality exists in the curve for the percent of carbon black contained within a given composition and it should be noted that the curves were derived through plaques provided in accordance with the foregoing disclosure after annealing at approximately 300° F. to obtain a constant room temperature resistance. This curve shows that the critical resistance, i.e., that percent of carbon black that produces a useful resistance in a semi-conductor of the type of this invention seems to occur at or about 5 to 8% or approximately 6%. It should be noted that the same point is achieved for the highly conductive Vulcan XC72 carbon black at or about 15% and this critical resistance is the subject of prior art discussion wherein it has been the goal of the prior art to reduce the content of highly conductive carbon black to 15% or below and to overcome those inherent resistivity deficiencies through extended annealing times.

In the aforementioned Cabot Corporation's Technical Service Report, the curves relating to the highly conductive Vulcan XC72 carbon black, a furnace black which has been identified as being one of the most conductive carbon blacks available, is shown to have a critical volume percent to be approximately 25% loading. It is therefore surprising that the Cabot Corporation's Mogul L and Cities Service Company's Raven 1255 which are considered to be essentially non-conductive and used in the manufacturing of printing inks permit the achievement of resistance levels which although much higher ($0.6\times10^3$ ohms for 20% Mogul L in polyethylene versus $0.06\times10^3$ ohms for 20% Vulcan XC72 in polyethylene) the critical volume percent loadings are much lower (approximately 6%) than with the highly conductive carbon black identified as Vulcan XC72.

In FIG. 6, the teachings of the present invention are shown incorporated into a self-limiting heating cable of indefinite length having a positive temperature co-efficient of resistance, substantially parallel stranded copper wire 10, 11 appropriately cleaned and tinned if desired, has extruded thereon (in accordance with standard extrusion techniques) the composition of this invention in what is referred to as a "dumbbell" cross-section so as to embrace the conductors at the area 12 and provide a continuous interconnecting web 13. A suitable form-retaining and insulating jacket or covering is also extruded by conventional techniques over the full length of the heating cable. The desired annealing for the requisite time is thereafter provided at the desired temperature, the cable being conventionally spooled for ease of handling and placed in a suitable oven.

From the foregoing, it is clear that the present invention contemplates the use of highly resistive carbon black instead of a highly conductive carbon black to achieve semi-conductor conductivity in ranges having commercial utility in heating cable, heating sensing devices and the like. Moreover, such highly resistive carbon blacks can be used in lower core loadings than would otherwise be expected so as to permit utilization of significantly shorter thermal structuring or anneal times thereby vastly increasing the economies of manufacture. These teachings can be used in connection with blending of the highly conductive materials with a highly resistive material to achieve reduced anneal times, a significant factor in the cost of present commercial products.

As will be apparent to persons skilled in the art, various modifications, adaptations and variations of the foregoing specific disclosure can be made without departing from the teachings of the present invention.

I claim:

1. The method of forming an electrically conductive composition having point-to-point electrical resistance that increases with increasing temperature comprising the steps of (a) uniformly mixing a thermoplastic polymer having at least 20% crystallinity as determined by X-ray diffraction with at least 6% by total weight of the mixture of a high dry resistivity carbon black;

(b) forming the desired shape; and (c) thermal structuring that shape by annealing at a temperature at or above the crystalline melting point of the polymer for not more than approximately 8 hours to produce a substantially constant stable room temperature electrical resistance.

2. The method of claim 1 wherein the mixing step includes the addition of high dry electrical resistance carbon black that is uniformly mixed with said low dry resistivity carbon black.

3. The method of claim 2 wherein the percentage by weight of the low dry resistivity carbon black and the high dry resistivity carbon black is 20% of the total weight of the mixture with the polymer.

4. The method according to claims 1, 2 or 3 wherein the forming step includes the extruding of the mix onto a pair of elongated electrodes held in spaced apart relation with the extruded mix forming an interconnecting web therebetween.

* * * * *

UNITED STATES PATENT AND TRADEMARK OFFICE

CERTIFICATE OF CORRECTION

PATENT NO. : 4,327,480

DATED : May 4, 1982

INVENTOR(S) : Cornelius James Noel Kelly, of Simsbury, Connecticut

It is certified that error appears in the above—identified patent and that said Letters Patent is hereby corrected as shown below:

Column 2, line 12, delete "stabiity" and substitute therefor --stability--.

Column 3, line 12, delete "flexibiliy" and substitute therefor --flexibility--.

Column 4, Table I, in the last column heading, delete "grms/cc" and substitute therefor --grams/cc--.

Column 4, line 29, delete "and" and substitute therefor --as--.

Column 4, line 55, delete "resitivity" and substitute therefor --resistivity--.

Column 5, line 60, delete "wil" and substitute therefor --will--.

Column 7, line 67, delete "produce" and substitute therefor --produces--.

Signed and Sealed this

*Twelfth* Day of *October 1982*

[SEAL]

*Attest:*

GERALD J. MOSSINGHOFF

*Attesting Officer*

*Commissioner of Patents and Trademarks*